US008925228B2

(12) United States Patent
Edmondson et al.

(10) Patent No.: US 8,925,228 B2
(45) Date of Patent: Jan. 6, 2015

(54) ART FRAMES

(75) Inventors: David Edmondson, San Diego, CA (US); Xiaoqi Zhou, San Diego, CA (US); Geoffrey Schmid, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 250 days.

(21) Appl. No.: 13/409,906

(22) Filed: Mar. 1, 2012

(65) Prior Publication Data

US 2013/0227868 A1 Sep. 5, 2013

(51) Int. Cl.
*A47G 1/06* (2006.01)

(52) U.S. Cl.
USPC ..... 40/788; 40/773; 40/774

(58) Field of Classification Search
CPC ..... A47G 1/0633; A47G 1/141; G09F 1/06; G09F 1/12; G09F 1/04
USPC ..... 40/769, 773, 788
See application file for complete search history.

(56) References Cited

U.S. PATENT DOCUMENTS

| | | | | |
|---|---|---|---|---|
| 2,085,097 | A | 6/1937 | Hansen | |
| 2,144,594 | A * | 1/1939 | Katz | 40/788 |
| 2,146,318 | A | 2/1939 | Viscount | |
| RE22,683 | E | 10/1945 | Piper | |
| 2,851,208 | A | 9/1958 | Samsing | |
| 3,053,001 | A | 9/1962 | Allen | |
| 3,214,855 | A | 11/1965 | Winkler et al. | |
| 3,240,130 | A | 3/1966 | Neff | |
| 3,559,316 | A * | 2/1971 | Galper | 38/102.91 |
| 3,733,809 | A | 5/1973 | Reiter et al. | |
| 4,112,604 | A | 9/1978 | Ott et al. | |
| 4,279,087 | A | 7/1981 | Crawford | |
| 4,606,140 | A * | 8/1986 | Mitchell et al. | 40/797 |
| 4,738,041 | A | 4/1988 | Drueck, Jr. | |
| 4,870,766 | A | 10/1989 | Topping | |

(Continued)

FOREIGN PATENT DOCUMENTS

| | | |
|---|---|---|
| DE | 3701293 | 4/1988 |
| GB | 589621 | 6/1947 |

(Continued)

OTHER PUBLICATIONS

Yang, H., "Fundamentals, Preparation , and Characterization of Superhydrophobic Wood Fiber Products", Thesis, 2008, Georgia Institute of Technology, 95 pages.

*Primary Examiner* — Casandra Davis
(74) *Attorney, Agent, or Firm* — Dierker & Associates, P.C.; Juliet Kavanaugh

(57) ABSTRACT

An art frame includes a three-dimensional supporting frame having an image receiving surface and a back surface opposed thereto, and a center portion defining a perimeter from which at least three foldable extensions extend. Each foldable extension includes no less than four folds folded toward the back surface to form a frame portion having an outer wall substantially perpendicular to the back surface, and an inner wall substantially perpendicular to the back surface and substantially parallel to the outer wall. A compressible member is attached to the outer walls to adhere an image receiving medium to the supporting frame. Compressible member includes a first adhesive on the outer walls, a polymer foam substrate (having a compression index ranging from about 0.4 to about 0.8) on the first adhesive, and a second adhesive on the polymer foam substrate. Second adhesive is to secure the image receiving medium to the supporting frame.

12 Claims, 4 Drawing Sheets

(56) References Cited

U.S. PATENT DOCUMENTS

| | | | | |
|---|---|---|---|---|
| 5,032,436 | A | 7/1991 | Gustafson | |
| 5,255,458 | A | 10/1993 | Piel | |
| 5,359,794 | A | 11/1994 | Wood | |
| 5,513,455 | A | 5/1996 | Walker | |
| 5,678,339 | A | 10/1997 | Marventano | |
| 5,679,145 | A | 10/1997 | Andersen et al. | |
| 5,683,772 | A | 11/1997 | Andersen et al. | |
| 5,947,437 | A | 9/1999 | Tate et al. | |
| 5,950,341 | A | 9/1999 | Cross | |
| 5,974,714 | A | 11/1999 | Jones | |
| 6,177,516 | B1 | 1/2001 | Hudak | |
| 6,265,037 | B1 | 7/2001 | Godavarti et al. | |
| 6,427,371 | B2 | 8/2002 | Olson et al. | |
| 6,475,713 | B1 | 11/2002 | Aylward et al. | |
| 6,541,852 | B2 | 4/2003 | Beroz et al. | |
| 6,649,245 | B2 | 11/2003 | Lenderink | |
| 6,883,908 | B2 | 4/2005 | Young et al. | |
| 7,818,904 | B2 | 10/2010 | Wagner | |
| 7,851,391 | B2 | 12/2010 | Bond et al. | |
| 7,918,047 | B1 | 4/2011 | Ngan | |
| 2002/0144445 | A1* | 10/2002 | Gomez del Campo Diaz Barrerio | 40/788 |
| 2003/0129361 | A1 | 7/2003 | Plug et al. | |
| 2003/0182833 | A1* | 10/2003 | Lewis | 40/551 |
| 2004/0159031 | A1 | 8/2004 | Chang | |
| 2006/0189236 | A1 | 8/2006 | Davis et al. | |
| 2007/0132778 | A1* | 6/2007 | Gallen et al. | 345/600 |
| 2009/0229157 | A1 | 9/2009 | Mehler | |
| 2010/0196603 | A1 | 8/2010 | Ohshima et al. | |
| 2011/0016759 | A1* | 1/2011 | Ramos-Gonzalez et al. | 40/773 |
| 2011/0088294 | A1 | 4/2011 | Docking | |
| 2012/0156402 | A1* | 6/2012 | Domanski et al. | 428/32.18 |
| 2013/0055609 | A1* | 3/2013 | Ridless et al. | 40/773 |
| 2013/0160340 | A1* | 6/2013 | Phillips | 40/765 |

FOREIGN PATENT DOCUMENTS

| | | |
|---|---|---|
| GB | 726212 | 3/1955 |
| GB | 1040995 | 9/1966 |
| GB | 1439323 | 6/1976 |
| GB | 2104378 | 3/1983 |
| GB | 2220854 | 1/1990 |
| GB | 2296866 | 7/1996 |
| GB | 2376916 | 12/2002 |
| GB | 2461863 | 1/2010 |

* cited by examiner

ART FRAMES

BACKGROUND

The global print market is in the process of transforming from analog printing to digital printing. Inkjet printing and electrophotographic printing are examples of digital printing techniques. These printing techniques have become increasingly popular for printing photographs and/or decorative art items. As examples, an image may be inkjet printed on canvas and then mounted on a wood frame, or an image may be liquid electro-photographically printed on a high gloss medium and then mounted on a metal plate.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

The present disclosure relates generally to art frames. Examples of the art frames disclosed herein are suitable for displaying photographs, art images, graphics, text, and/or the like, and/or combinations thereof. The art frames disclosed herein include an inner support member that is secured to a three-dimensional supporting frame. The inner support member adds strength to the frame while also making a back side of the art frame more aesthetically pleasing, for example, compared to when the inner support member is not utilized. The art frames also include a compressible member that adheres an image receiving medium to the outer walls of the three-dimensional supporting frame. The compressible member has a compression index that firmly connects the image receiving medium to the supporting frame while reducing expansion-related issues, which may be the result of either moisture induced expansion or stress induced expansion from mismatch of thermal expansion coefficients.

Figure 1:
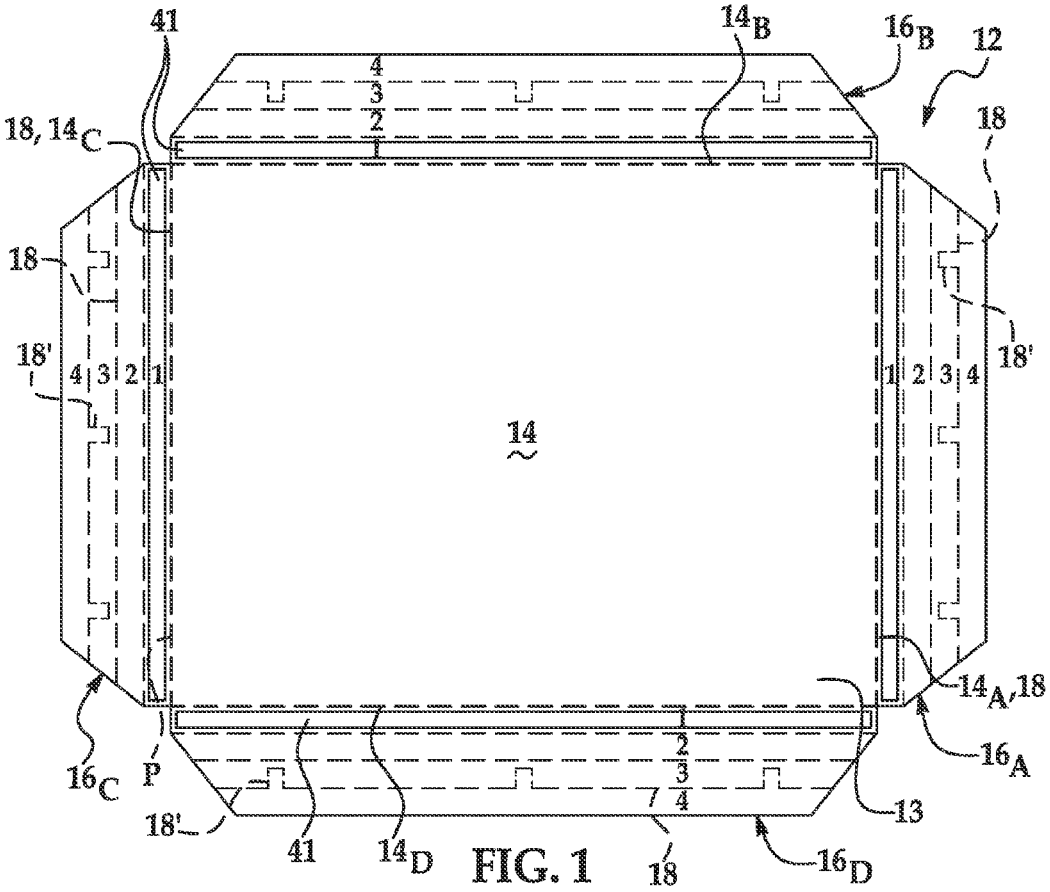
FIG. 1 is a front view of an example of a foldable material used to form an example of a three-dimensional supporting frame.

Referring now to FIG. 1, an example of a foldable material 12 is depicted. The foldable material 12 is pre-cut and scored so that when it is folded, it forms the three-dimensional supporting frame 20 (see FIG. 2A). While the foldable material 12 shown in FIG. 1 is used to make a rectangular three-dimensional supporting frame 20, it is to be understood that foldable material 12 may be pre-cut and scored to have any desirable shape. As examples, the foldable material 12 may be shaped so that when folded, any of the following three-dimensional supporting frames is formed: a square three-dimensional supporting frame, a triangular three-dimensional supporting frame (20' in FIG. 3), a circular three-dimensional supporting frame (20" in FIG. 4), or a polygonal three-dimensional supporting frame (20''' in FIG. 5).

FIG. 1 is a front view of the foldable material 12, which has a center portion 14 that includes at least four sides $\mathbf{14}_A$, $\mathbf{14}_B$, $\mathbf{14}_C$, $\mathbf{14}_D$ which define a perimeter P.

When the center portion 14 has four sides $\mathbf{14}_A$, $\mathbf{14}_B$, $\mathbf{14}_C$, $\mathbf{14}_D$, the center portion 14 may be square, rectangular, or circular. When the center portion 14 has three sides, the shape of the center portion is a triangle, and when the center portion 14 more than four sides, the shape of the center portion 14 will depend upon the number of sides (e.g., five sides correspond with a pentagon shaped center portion 14, six sides correspond with a hexagon shaped center portion 14, etc.).

The foldable material 12 also has two opposed surfaces, namely an image receiving surface 13 and a back surface 15 (FIG. 2A) that is opposed to the image receiving surface 13.

A foldable extension $\mathbf{16}_A$, $\mathbf{16}_B$, $\mathbf{16}_C$, $\mathbf{16}_D$ respectively extends from each side $\mathbf{14}_A$, $\mathbf{14}_B$, $\mathbf{14}_C$, $\mathbf{14}_D$ of the center portion 14. The foldable extensions $\mathbf{16}_A$, $\mathbf{16}_B$, $\mathbf{16}_C$, $\mathbf{16}_D$ may be scored with fold lines 18 that are meant to guide the folding of the foldable extensions $\mathbf{16}_A$, $\mathbf{16}_B$, $\mathbf{16}_C$, $\mathbf{16}_D$ toward the back surface 15 of the center portion 14. In an example, each foldable extension $\mathbf{16}_A$, $\mathbf{16}_B$, $\mathbf{16}_C$, $\mathbf{16}_D$ has no less than four fold lines 18 defining no less than four respective folds. In the example shown in FIG. 1, there are four folds 1, 2, 3, 4. In this example then, each foldable extension $\mathbf{16}_A$, $\mathbf{16}_B$, $\mathbf{16}_C$, $\mathbf{16}_D$ is foldable four times, once along each scored fold line 18. In other examples, it is to be understood that more than four fold lines 18 may be included on any one foldable extension $\mathbf{16}_A$, $\mathbf{16}_B$, $\mathbf{16}_C$, $\mathbf{16}_D$ so that the foldable extension $\mathbf{16}_A$, $\mathbf{16}_B$, $\mathbf{16}_C$, $\mathbf{16}_D$ is foldable more than four times.

In this example, the outermost fold line 18 defining the fold 4 and part of the fold 3 also defines a tab line 18'. The tab line 18' may be scored so that when the folds 4 are folded, a tab 26 (FIG. 2A) disconnects (either automatically or with application of a small force) along the tab line 18'. The tab 26 can then be folded toward and secured to the surface 15 (FIG. 2A).

Figure 2A:
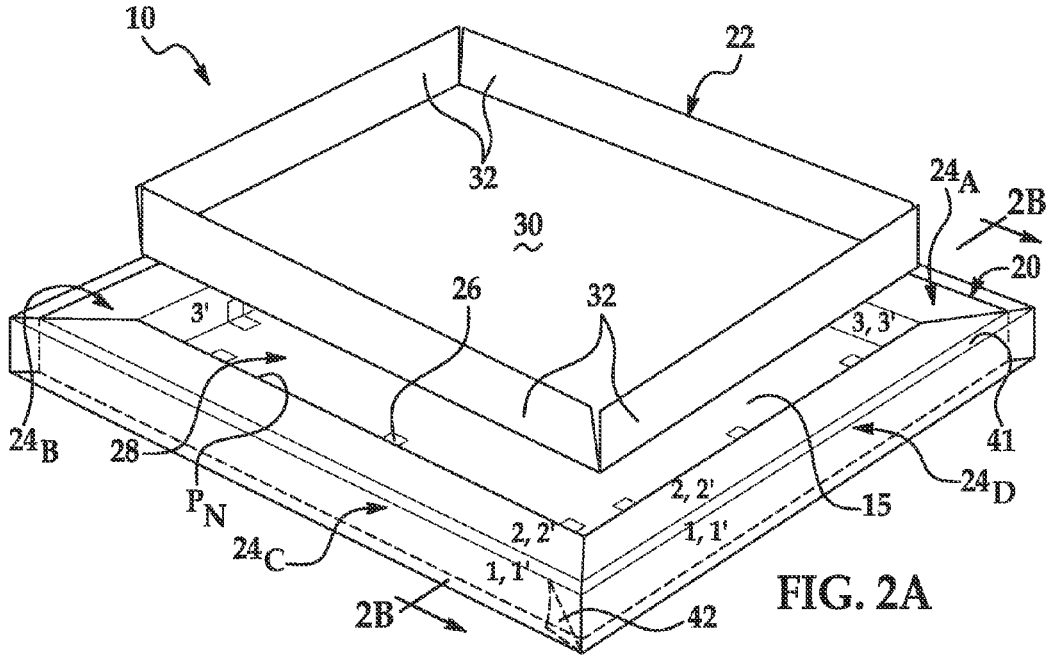
FIG. 2A is a back, perspective, exploded view of an art frame including the three-dimensional supporting frame formed from the foldable material of FIG. 1 and an example of an inner support member to be secured to the three-dimensional supporting frame.

The foldable extensions $\mathbf{16}_A$, $\mathbf{16}_B$, $\mathbf{16}_C$, $\mathbf{16}_D$ and the folds 1, 2, 3, 4 may have any suitable shape that allows the folds 1, 2, 3, 4 of the respective foldable extension $\mathbf{16}_A$, $\mathbf{16}_B$, $\mathbf{16}_C$, $\mathbf{16}_D$ to be folded toward the surface 15 to form a three-dimensional frame portion ($\mathbf{24}_A$, $\mathbf{24}_B$, $\mathbf{24}_C$, and $\mathbf{24}_D$ in FIG. 2A). As shown in FIG. 1, each of the foldable extensions $\mathbf{16}_A$, $\mathbf{16}_B$, $\mathbf{16}_C$, $\mathbf{16}_D$ is partially angled at opposed edges so that when the folds 1, 2, 3, 4 are folded, the resulting frame portion $\mathbf{24}_A$, $\mathbf{24}_B$, $\mathbf{24}_C$, and $\mathbf{24}_D$ abuts an adjacent frame portion. In an example, the abutting frame portions $\mathbf{24}_A$, $\mathbf{24}_B$, $\mathbf{24}_C$, and $\mathbf{24}_D$ form respective corners of the three-dimensional supporting frame 20.

The foldable material 12 may be made of any foldable material with suitable stiffness that can be folded over at least 90° with the assistance of scoring without cracking and/or breaking. When the foldable material 12 is a cellulose fiber-based paper or paper board, the stiffness of the foldable material 12 is greater than 25 Taber units (gf-cm). In an example, the stiffness of the foldable material 12 ranges from about 100 Taber units to about 3000 Taber units (TAPPI method T489-om).

In another example, the stiffness of the foldable material 12 ranges from about 500 Taber units to about 2000 Taber units (TAPPI method T489-om). Stiffness, k, of a body is a measure of the resistance offered by an elastic body to deformation. For an elastic body with a single degree of freedom (for example, stretching or compression of a rod), the stiffness, k, is defined as $$k = \frac{F}{\delta}$$

where F is the force applied on the body and δ is the displacement produced by the force along the same degree of freedom. Examples of the foldable material 12 include pure element materials, such as aluminum foil; compounds of multiple elements, such as copper-zinc alloy foil; synthetic polymers, such as toughened polypropylene; natural products, such as cellulose paper (e.g., cardboard); or composites, such as polyethylene terephthalate/calcium carbonate (PET/$CaCO_3$) coextruded sheets. Other examples of the foldable material 12 include carton board (e.g., solid bleached board, solid unbleached board), white lined chipboard, liquid packaging board, folding boxboard, container board (e.g., liner board), wall paper substrates, uncoated cover paper, or the like.

FIG. 1 also illustrates a compressible member 41 on the image receiving surface 13 at each of the folds 1. The compressible member 41 covers the fold 1, and is used to adhere a portion of an image receiving medium (reference numeral 44 in FIG. 2C) to the supporting frame 20. The compressible member 41 is a double sided adhesive which includes a polymer foam substrate sandwiched between a first adhesive and a second adhesive. The various layers of the compressible member 41 will be further described in reference to FIG. 2B.

Referring now to FIG. 2A, an example of the art frame 10 is shown. As previously stated, the art frame 10 includes the three-dimensional supporting frame 20 (formed from foldable material 12), and an inner support member 22. While an exploded view is shown in FIG. 2A, it is to be understood that the inner support member 22 is to be secured to the back surface 15, as will be described further hereinbelow.

To construct the three-dimensional supporting frame 20, fold 1 of each of the extensions $\mathbf{16}_A$, $\mathbf{16}_B$, $\mathbf{16}_C$, $\mathbf{16}_D$ is folded inward (i.e., towards the surface 15). The fold 1 of a respective extension $\mathbf{16}_A$, or $\mathbf{16}_B$, or $\mathbf{16}_C$, or $\mathbf{16}_D$ forms an outer wall 1' of the respective frame portion $\mathbf{24}_A$, $\mathbf{24}_B$, $\mathbf{24}_C$, or $\mathbf{24}_D$. All together, the outer walls 1' form the exterior perimeter wall of the art frame 10. As illustrated, fold 1 is folded so that the compressible member 41 is on the outer walls 1' of the supporting frame 20. Fold 2 of each of the extensions $\mathbf{16}_A$, $\mathbf{16}_B$, $\mathbf{16}_C$, $\mathbf{16}_D$ is folded inward (i.e., towards the surface 15). The fold 2 of a respective extension $\mathbf{16}_A$, or $\mathbf{16}_B$, or $\mathbf{16}_C$, or $\mathbf{16}_D$ forms a back wall 2' of the respective frame portion $\mathbf{24}_A$, $\mathbf{24}_B$, $\mathbf{24}_C$, or $\mathbf{24}_D$. All together, the back walls 2' form the back wall of the art frame 10. Fold 3 of each of the extensions $\mathbf{16}_A$, $\mathbf{16}_B$, $\mathbf{16}_C$, $\mathbf{16}_D$ is then folded inward (i.e., towards the surface 15). The fold 3 of a respective extension $\mathbf{16}_A$, or $\mathbf{16}_B$, or $\mathbf{16}_C$, or $\mathbf{16}_D$ forms an inner wall 3' of the respective frame portion $\mathbf{24}_A$, $\mathbf{24}_B$, $\mathbf{24}_C$, or $\mathbf{24}_D$. All together, the inner walls 3' form an inner perimeter wall, which has a new perimeter $P_N$. The space 28 defined by the inner walls 3' receives the inner support member 22. Finally, when creating the three-dimensional supporting frame 20, fold 4 of each of the extensions $\mathbf{16}_A$, $\mathbf{16}_B$, $\mathbf{16}_C$, $\mathbf{16}_D$ is then folded inward (i.e., towards the surface 15). These folds 4 are adhered, or otherwise secure to, the surface 15 of the foldable material 12 at the center portion 14. As illustrated in FIG. 2A, each of the outer walls 1' is substantially perpendicular to the back wall 2' of the same frame portion $\mathbf{24}_A$, $\mathbf{24}_B$, $\mathbf{24}_C$, or $\mathbf{24}_D$, and each of the inner walls 3' is substantially perpendicular to the back wall 2' and substantially parallel to the outer wall 1' of the same frame portion $\mathbf{24}_A$, $\mathbf{24}_B$, $\mathbf{24}_C$, or $\mathbf{24}_D$.

When folds 3 and/or 4 are folded, the tab line 18' disconnects (either automatically or with application of a small force) from the foldable material 12 to form the tab 26. As shown in FIG. 2A, the tab 26 may be folded toward and secured to the surface 15. It is to be understood that within the tab lines 18' on the surface 13, the fold 3 may have an adhesive layer and a release liner (both of which are described below) attached thereto. This may be desirable to secure the tab 26 to the surface 15 as shown in FIG. 2A.

An adhesive layer (see reference numeral 34 in FIG. 2B) may also be used to secure the folds 4 to the surface 15. When folding the folds 1, 2, 3, and 4, the adhesive layer 34 may be applied to fold 4 and then adhered to the surface 15. Once the folds 4 are secured, the frame portions $\mathbf{24}_A$, $\mathbf{24}_B$, $\mathbf{24}_C$, and $\mathbf{24}_D$ and the three-dimensional supporting frame 20 are formed. The adhesive layer 34 may also be pre-coated onto the surface 13 at the outermost fold 4. Prior to folding, the pre-coated adhesive layer 34 may have a removable/release liner (not shown) attached thereto. The adhesive layer 34 may be applied to the surface 13 of the foldable material 12 at folds 4 using an air knife coater, a rod coater, a slot die coater, roll coater, or a film transfer coater. In one example, the adhesive layer 34 is applied directly onto a release liner, and then the adhesive layer on the glued release liner is laminated onto the desired portion (e.g., fold 4) of the foldable material 12 using a laminator. The removable liner may protect the adhesive layer from contamination and from prematurely adhering.

The adhesive used to secure the tabs 26 and the folds 4 (i.e., adhesive 34) to the surface 15 may be a solvent-based adhesive or a water-based adhesive. Solvents suitable for the solvent-based adhesive include heptanes, toluene, ethyl acetate, pentane-2,4-dione, and alcohols. In some instances, it may be desirable to utilize an aqueous-based water soluble and/or water dispersible adhesive. In an example, the adhesive used to secure the tabs 26 and the folds 4 is formed of a synthetic polymer with a weight average molecular weight ranging from about 200,000 to about 800,000 when the structure is linear, or ranging from about 300,000 to about 1,500,000 when the structure is branched or cross-linked. The adhesive may also have a pressure sensitive nature. For example, the adhesive may have a glass transition temperature ($T_g$) ranging from about −70° C. to about −40° C., and a peeling strength equal to or greater than 20 Newton/$cm^2$ (e.g., as measured according to an ASTM (f.k.a. the American Society for Testing and Materials) test method, namely ASTM 3330M using an INSTRON® tester).

Suitable examples of the adhesive used to secure the tabs 26 and the folds 4 are polyacrylates, polyvinyl ethers, silicone resins, polyacrylic resins, elastic hydrocarbon polymers (e.g., nitrile rubbers, butyl rubbers, polyisobutylenes, polyisoprenes, etc.), ethylene-vinyl acetate copolymers, or styrene block copolymers (e.g., styrene-butadiene-styrene (SBS), styrene-ethylene-styrene, styrene-butylene-styrene, styrene-ethylene, or styrene-propylene). Some suitable adhesive may be polymers of acrylate addition monomers, such as C1 to C12 alkyl acrylates and methacrylates (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, and tert-butyl methacrylate); aromatic monomers (e.g., styrene, phenyl methacrylate, o-tolyl methacrylate, m-tolyl methacrylate, p-tolyl methacrylate, and benzyl methacrylate); hydroxyl containing monomers (e.g., hydroxyethylacrylate and hydroxyethylmethacrylate); carboxylic acid containing monomers (e.g., acrylic acid and methacrylic acid); vinyl ester monomers (e.g., vinyl acetate, vinyl propionate, vinylbenzoate, vinyl pivalate, vinyl-2-ethylhexanoate, and vinyl-versatate); vinyl benzene monomers; and C1-C12 alkyl acrylamide and methacrylamide (e.g., t-butyl acrylamide, sec-butyl acrylamide, N,N-dimethylacrylamide).

The adhesive used to secure the tabs 26 and the folds 4 (e.g., adhesive 34) may be a copolymer of at least two of the monomers listed herein. In an example, the molecular structure of the formed copolymer has soft segments ($T_g$ ranging from about −70° C. to about −20° C.) and small hard segments ($T_g$ ranging from about −10° C. to about 100° C.). The copolymer may also include functional monomers, i.e., the chemical groups on the molecular chain can react to form a cross-linked structure. Examples of functional monomers include methacrylic acid, acrylic acid, glycidyl methacrylate, and hydroxyethyl acrylate.

In another example, the adhesive used to secure the tabs 26 and the folds 4 (e.g., adhesive 34) includes a compound having a structure of unsaturated rings. Examples of such compounds include glycerol ester of abietic acid, pentaerythritol ester of abietic acid, and terpene resins derived from alfa-pinene and beta-pinene.

The adhesive used to secure the tabs 26 and the folds 4 may be applied to have a coat weight ranging from 25 gsm to about 60 gsm. If the adhesive layer coat weight is less than 25 gsm, the bond strength will decrease and adhesion failure may result.

The release liner may include a substrate and release coating deposited on the release coating. The substrate may be a cellulose paper and/or a polymeric film, such as polyethylene, polypropylene or polyethylene terephthalate (PET). The release coating is made of material(s) that is/are readily able to delaminate from the adhesive layer and do not migrate or transfer to the released material (i.e., adhesive layer) to any significant degree. Examples of the release coating of the release liner include polyacrylates, carbamates, polyolefins, fluorocarbons, chromium stearate complexes and silicones. In one example, the silicones release coating may be desirable, at least in part because it can easily be applied on various substrates and can be cured into a polydimethylsiloxane (PDMS) network, which limits migration into an adhesive matrix. Silicones may also allow substantially lower release forces than other materials.

FIG. 2A also illustrates the inner support member 22. In an example, the inner support member 22 is formed of a blank that includes an inner support member (ISM) center portion 30 and side securing members 32 extending from the ISM center portion 30. The blank may be made of any of the materials suitable for forming the foldable material 12. The blank may be the same material as the foldable material 12 or may be a different material than the foldable material 12. The blank is pre-scored to define the ISM center portion 30 and the side securing members 32. Each of the side securing members 32 is integrally formed with the ISM center portion 30, but is not attached to any of the adjacent side securing members 32. As such, each of the side securing members 32 is a separate flap. This enables each of the side securing members 32 to be individually attached to the respective inner walls 3' of the three-dimensional supporting frame 20.

The ISM center portion 30 has the same shape, and approximately the same size as the new perimeter $P_N$. It is to be understood that the inner support member 22 fits into the space 28 defined by the inner walls 3'. As such, the ISM center portion 30 may be slightly smaller than the new perimeter $P_N$ so that the side securing members 32 are able to fit into the space 28 and adhere to the respective inner walls 3' as described herein.

To attach the inner support member 22 to the three-dimensional supporting frame 20, an adhesive (reference numeral 34' in FIG. 2B) may be present on the inner walls 3' of the three-dimensional supporting frame 20, and in some instances on the back surface 15 at the center portion 14. The adhesive 34' used to secure the inner support member 22 to the three-dimensional supporting frame 20 may be any of the adhesives previously described for the adhesive 34. Prior to adhering the inner support member 22, any release liners present on the adhesive 34' may be removed.

The inner support member 22 is positioned in the space 28 of the three-dimensional supporting frame 20. Each side securing member 32 is adhered to one of the inner walls 3' of the three-dimensional supporting frame 20, and the ISM center portion 30 contacts the back surface 15 of the three-dimensional supporting frame 20. While not shown in FIG. 2A, it is to be understood that when the inner support member 22 is adhered to the three-dimensional supporting frame 20, the back surface 15 and the tabs 26 are covered by the inner support member 22. The inner support member 22 supports the three-dimensional supporting frame 20, so that the three-dimensional supporting frame 20 maintains its shape and stability.

Figure 2B:
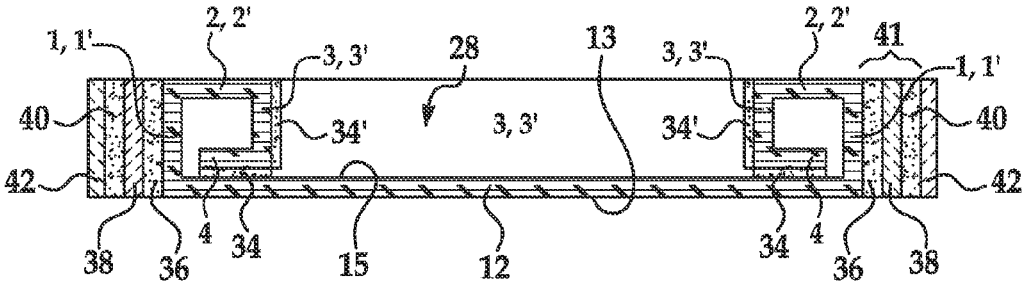
FIG. 2B is a semi-schematic, cross-sectional view of the three-dimensional supporting frame taken along line 2B-2B in FIG. 2A.

As shown in FIGS. 2A and 2B, when the foldable material 12 is folded, the compressible member 41 is positioned on the outer walls 1' of the three-dimensional supporting frame 20. As illustrated in the semi-schematic cross-sectional view shown in FIG. 2B, the compressible member includes the polymer foam substrate 38 and adhesives 36 and 40 on opposed sides of the polymer foam substrate 38.

The polymer foam substrate 38 is a polymer elastomer that has a compression index ranging from about 0.4 to about 0.8. This enables the double sided adhesive to be compressible when stress is applied or expandable back to its original state when the stress is removed. It is believed that if the compression index is too high, the foam substrate 38 of the double sided adhesive will be too soft to provide adequate support to the three-dimensional supporting frame 20. It is also believed that if the compression index is too low, the inner support member 22 may be difficult to install into the three-dimensional supporting frame 20. Any suitable polymer elastomer may be used, including polyurethane and rubber materials. In an example, a polyolefin is not used as the polymer foam substrate 38, at least in part because of its poor binding properties.

The first and second adhesives 36, 40 may be a solvent-based adhesive or a water-based adhesive. Solvents suitable for the solvent-based adhesive include heptanes, toluene, ethyl acetate, pentane-2,4-dione, and alcohols. In some instances, it may be desirable to utilize an aqueous-based water soluble and/or water dispersible adhesive. In an example, the adhesives 36, 40 are each formed of a synthetic polymer with a weight average molecular weight ranging from about 200,000 to about 800,000 when the structure is linear, or ranging from about 300,000 to about 1,500,000 when the structure is branched or cross-linked. The adhesives 36, 40 may also have a pressure sensitive nature. For example, the adhesives 36, 40 may have a glass transition temperature ($T_g$) ranging from about −70° C. to about −40° C., and a peeling strength equal to or greater than 20 Newton/cm$^2$ (e.g., as measured according to an ASTM (f.k.a. the American Society for Testing and Materials) test method, namely ASTM 3330M using an INSTRON® tester).

Suitable examples of the adhesives 36, 40 are polyacrylates, polyvinyl ethers, silicone resins, polyacrylic resins, elastic hydrocarbon polymers (e.g., nitrile rubbers, butyl rubbers, polyisobutylenes, polyisoprenes, etc.), ethylene-vinyl acetate copolymers, or styrene block copolymers (e.g., styrene-butadiene-styrene (SBS), styrene-ethylene-styrene, styrene-butylene-styrene, styrene-ethylene, or styrene-propylene). Some suitable adhesives 36, 40 may be polymers of acrylate addition monomers, such as C1 to C12 alkyl acrylates and methacrylates (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, and tert-butyl methacrylate); aromatic monomers (e.g., styrene, phenyl methacrylate, o-tolyl methacrylate, m-tolyl methacrylate, p-tolyl methacrylate, and benzyl methacrylate); hydroxyl containing monomers (e.g., hydroxyethylacrylate and hydroxyethyl methacrylate); carboxylic acid containing monomers (e.g., acrylic acid and methacrylic acid); vinyl ester monomers (e.g., vinyl acetate, vinyl propionate, vinylbenzoate, vinyl pivalate, vinyl-2-ethylhexanoate, and vinyl-versatate); vinyl benzene monomers; and C1-C12 alkyl acrylamide and methacrylamide (e.g., t-butyl acrylamide, sec-butyl acrylamide, N,N-dimethylacrylamide).

The adhesives 36, 40 may be copolymers of at least two of the monomers listed herein. In an example, the molecular structure of the formed copolymer has soft segments ($T_g$ ranging from about −70° C. to about −20° C.) and small hard segments ($T_g$ ranging from about −10° C. to about 100° C.). The copolymer may also include functional monomers, i.e., the chemical groups on the molecular chain can react to form a cross-linked structure. Examples of functional monomers include methacrylic acid, acrylic acid, glycidyl methacrylate, and hydroxyethyl acrylate.

In another example, the adhesives 36, 40 include a compound having a structure of unsaturated rings. Examples of such compounds include glycerol ester of abietic acid, pentaerythritol ester of abietic acid, and terpene resins derived from alfa-pinene and beta-pinene.

Each of the adhesives 36, 40 may be applied to have a coat weight ranging from 25 gsm to about 60 gsm. If the coat weight of the respective adhesives 36, 40 is less than 25 gsm, the bond strength will decrease and adhesion failure may result. Additionally, the adhesives 36, 40 may be the same material, or they may be different materials.

As shown in FIGS. 2A and 2B, a release liner 42 may be positioned on the outermost adhesive (i.e., the second adhesive 40) of the compressible member 41. Any of the release liners described above may be utilized.

Figure 2C:
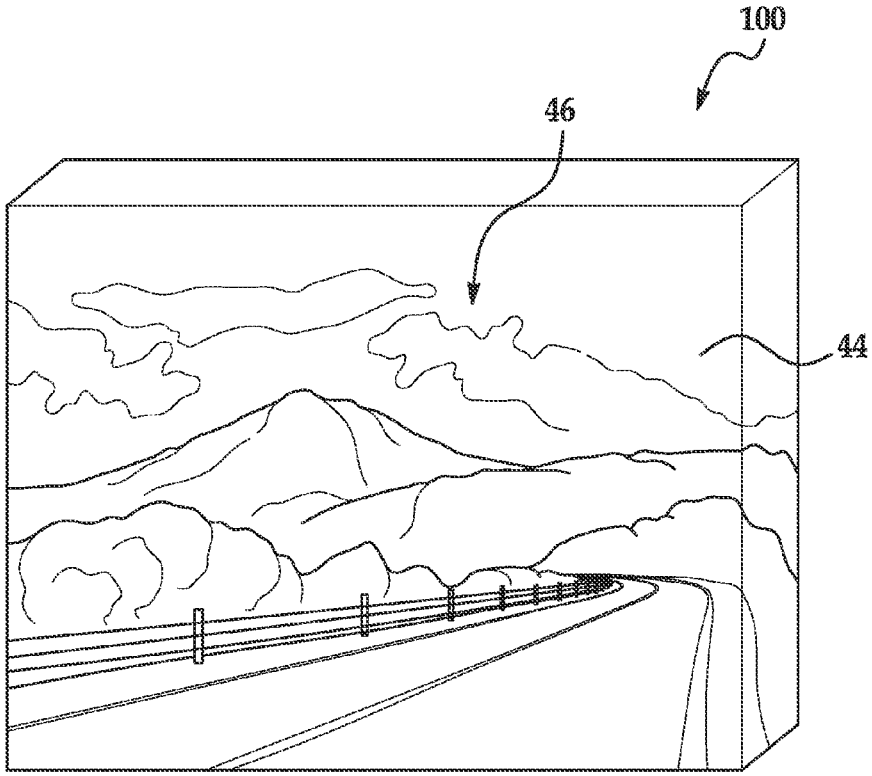
FIG. 2C is a front, perspective view of the art frame of FIG. 2A with an image receiving medium adhered thereto.

Referring now to FIG. 2C, the art frame 10 is shown with an image receiving medium 44 adhered thereon. An image 46 is printed on the image receiving medium 44, and then the image receiving medium 44 is adhered to the surface 13 of the foldable material 12 as it is shown in FIG. 1, i.e., before the material 12 is folded to form the three-dimensional supporting frame 20.

The image receiving medium 44 may be any medium that is suitable for use with any digital printing device, such as a digital inkjet printer, a liquid electrophotographic printer (a liquid toner printer), or an electrophotographic printer (a dry toner laser printer). Any of these printers may be utilized to print the image 46, which may be based upon a digital image (e.g., a digital photograph) and/or may include text and/or graphics.

The image receiving medium 44 is a foldable material which has a specific surface that is able to receive a digital image with high print quality. The specific surface may be made by coating or depositing a digital ink/toner receiving layer onto the outermost surface of a base substrate. In this example, coating or depositing refers to the application of a specifically formulated chemical composition onto the outermost surface of the base substrate of the image receiving medium by a suitable process which includes any type of coating process. The specific surface may also be made by surface treating the base substrate via a physical and/or chemical process (e.g., corona treatment, plasma grafting polymerization and/or acid etching). In this example, surface treating refers to a method for altering the surface structure or morphology chemically and/or physically without applying any foreign composition to cover the surface of the base substrate. The surface treating method modifies the nature of the base substrate surface by changing the surface morphology or changing the surface chemical functional groups.

In one example, the image receiving medium 44 includes a cellulose paper base, and the outermost surface of the cellulose paper base is surface functionalized with a digital ink/toner receiving layer. The composition of the digital ink/toner receiving layer may include binder(s) (e.g., water-based binders such as polyvinyl alcohol, styrene-butadiene emulsion, acrylonitrile-butadiene latex, or combinations thereof) and inorganic pigment particle(s) (e.g., clay, kaolin, calcium carbonate, or combinations thereof). The digital ink/toner receiving layer may be subjected to an embossing treatment to create a desirable surface texture which is represented by a lay pattern. "Lay" is a measure of the direction of the predominant machining pattern. A lay pattern is a repetitive impression created on the surface of a part. The lay patterns created on the image receiving medium 24 include, for example, vertical patterns, horizontal patterns, radial patterns, circular patterns, isotropic patterns and cross hatched patterns.

In another example, the image receiving medium 44 is made of a foldable material based on a polymeric film. Examples of suitable polymeric films include polyolefin films (e.g., polyethylene and polypropylene films), polycarbonate films, polyamide films, polytetrafluoroethylene (PTFE) films. These polymeric films can be used alone, or they can be co-extruded with another material, such as cellulose paper, to form a foldable image receiving medium. In some examples, the polymeric film surface is pre-coated with an example of the digital ink/toner receiving layer disclosed herein and/or is surface treated to improve the ink reception and toner adhesion.

In yet another example, the image receiving medium 44 is made of a foldable ductile metal foil. The metal foil may be a pure metal and/or a metal alloy. In some examples, the metal foil surface is pre-coated with an example of the digital ink/toner receiving layer disclosed herein and/or is surface treated to improve the ink reception and toner adhesion.

As mentioned above, the image 46 may be created using any suitable digital printing technique. It is believed that the durability of the printed image 46 may be the result of the combination of the medium 44 and the ink or toner that is used. For example, a medium 44 including a digital ink/toner receiving layer or having been surface treated may be desirable when digital electrophotographic printing is used with toners that contain a durable colorant and UV, light and ozone fastness resin binders. In another example, a durable printed image 46 is formed when a pigment inkjet ink is printed, using inkjet technology, onto a micro-porous image receiving medium 44. In this example, a pigment or any number of pigment blends may be provided in the inkjet ink formulation to impart color to the ink. As such, the pigment may be any number of desired pigments dispersed throughout the resulting inkjet ink. More particularly, the pigment included in the inkjet ink may include self-dispersed (surface modified) pigments, or pigments accompanied by a dispersant.

The image receiving medium 44 may be the same shape and size as the center portion 14 and the innermost fold 1 of the foldable extensions $\mathbf{16}_A$, $\mathbf{16}_B$, $\mathbf{16}_C$, $\mathbf{16}_D$. The image receiving medium 44 may also be the same size and shape as the center portion 14 and the folds 1 and 2 of the foldable extensions $\mathbf{16}_A$, $\mathbf{16}_B$, $\mathbf{16}_C$, $\mathbf{16}_D$. In these examples, at least a portion of the image receiving medium 44 is folded with the fold 1 or the folds 1 and 2 of the foldable extensions $\mathbf{16}_A$, $\mathbf{16}_B$, $\mathbf{16}_C$, $\mathbf{16}_D$.

After the image 46 is applied thereon, the image receiving medium 44 is aligned with the respective portions of the foldable material 12 and is secured thereto. The compressible member 41 adheres the image receiving medium 44 to the folds 1 (and then to outer walls 1' when the foldable material 12 is folded), and another adhesive may be used to adhere the image receiving medium 44 to the center portion 14, or the center portion 14 and the folds 2. The other adhesive used to adhere the image receiving medium 44 to portions of the foldable material 12 may be any of the adhesives previously described herein. It is to be understood that in these examples, removable/release liners may be positioned on the adhesive layer and on the compressible member 31 until it is desirable to adhere the image receiving medium 44 to the foldable material.

In an example, the adhesive layer that adheres portions of the image receiving medium 44 to the center portion 14, or the center portion 14 and the folds 2 of the foldable material 12 has a thickness ranging from about 15 μm to about 450 μm. If the adhesive layer thickness is less than 15 μm, the internal stress generated between the image receiving medium 44 and the foldable material foldable material 12 may cause adhesion failure. In some instances, the adhesive layer exhibits a pressure sensitivity property. This property provides an adhesion strength between two adhered surfaces, for example, when a moderate pressure is applied (e.g., by hands).

After the image receiving medium is adhered to the desired portions of the foldable material 12 and prior to folding, rubber rollers may be used to apply force to the adhered materials to remove any air bubbles entrapped between the adhered materials.

As mentioned above, the image receiving medium 44 may be the same shape and size as a portion of the foldable material 12. As such, the image receiving medium 44 may have an image receiving portion that is shaped and sized in the same manner as the center portion 14 of the foldable material 12, and image receiving extensions that respectively extend from each side of the image receiving portion and include one or two folds similar to folds 1 and 2 of the foldable material 12. The extensions of the image receiving medium may be scored with fold lines similar to the fold lines defining folds 1 or folds 1 and 2.

After the image receiving medium 44 is adhered to the foldable material 12 the material 12 is folded as previously described. The inner support member 22 is then inserted into the space 28 and the side securing members 32 are adhered to the inner walls 3'. This forms the art canvas 100 shown in FIG. 2C.

Figure 3:
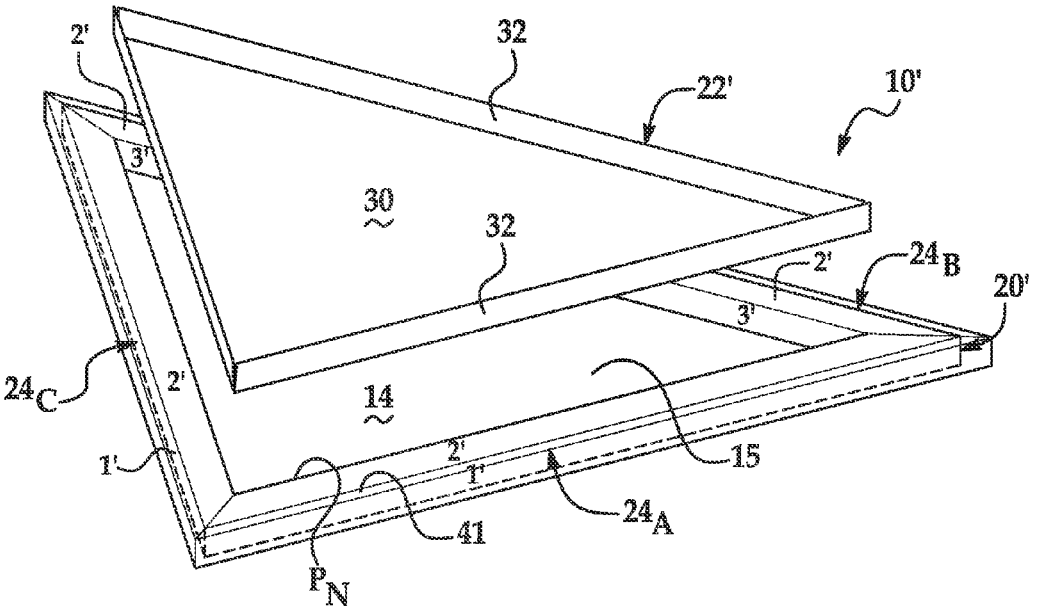
FIG. 3 is a back, perspective, exploded view of another example of an art frame including an example of a triangularly shaped three-dimensional supporting frame and an inner support member to be secured to the three-dimensional supporting frame.
Figure 4:
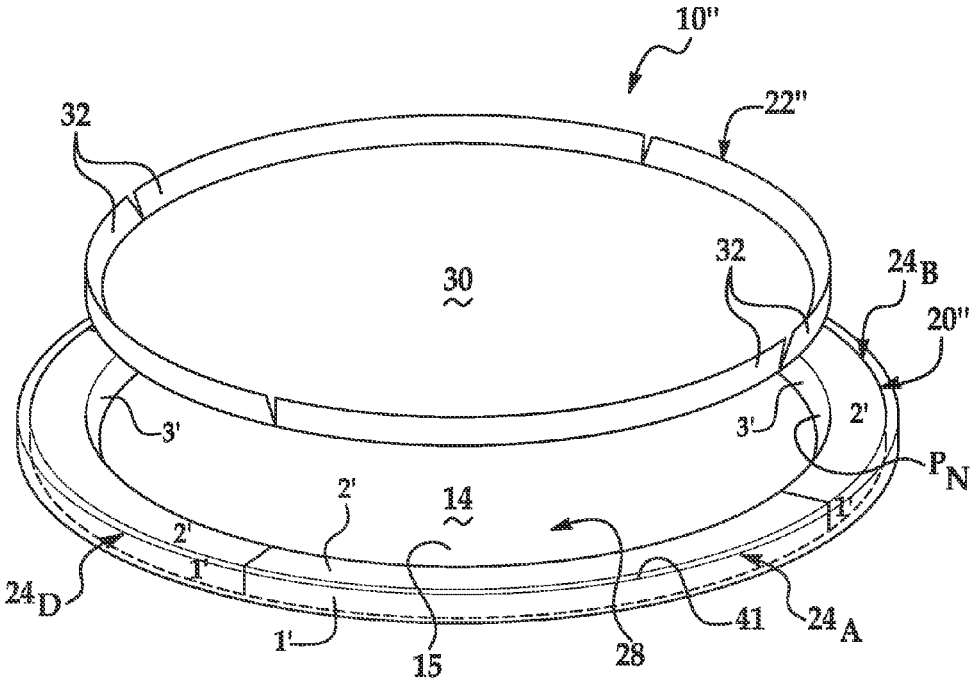
FIG. 4 is a back, perspective, exploded view of still another example of an art frame including an example of a circular shaped three-dimensional supporting frame and an inner support member to be secured to the three-dimensional supporting frame.
Figure 5:
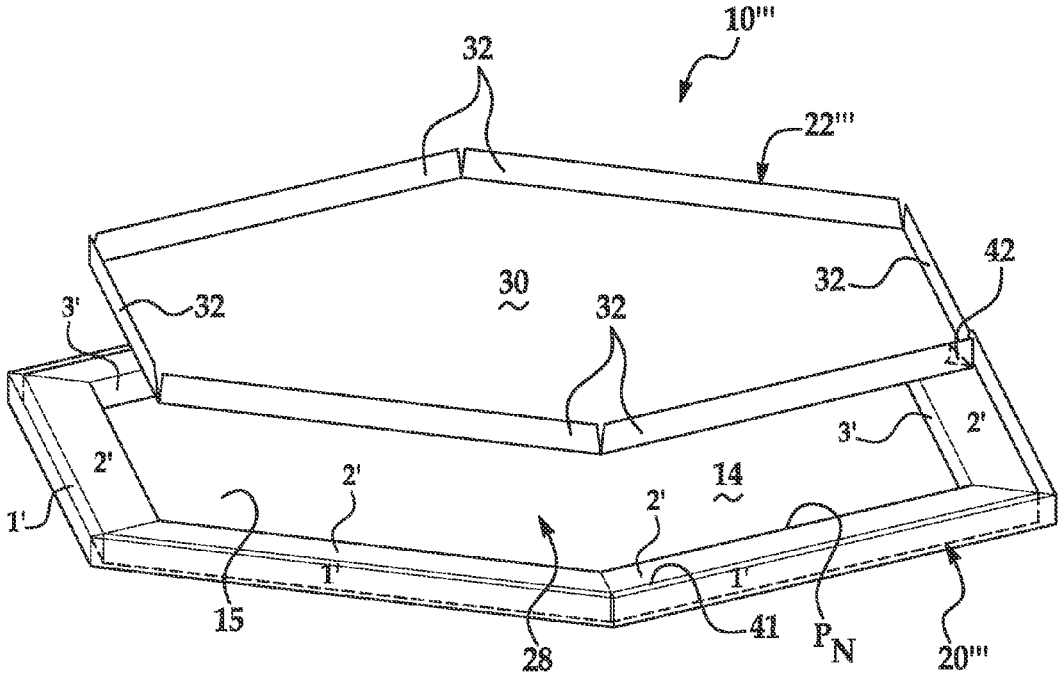
FIG. 5 is a back, perspective, exploded view of yet another example of an art frame including an example of a polygon shaped three-dimensional supporting frame and an inner support member to be secured to the three-dimensional supporting frame.

FIGS. 3 through 5 depict art frames 10', 10", 10'" with different shapes. Each of the art frames 10', 10", 10'" includes a three-dimensional supporting frame 20', 20", 20'" and a corresponding inner support member 22', 22", 22'". While not shown, the art frames 10', 10", 10'" may also include the image receiving medium 44 adhered to the three-dimensional supporting frame 20', 20", 20'". The three-dimensional supporting frames 20',20", 20'" are formed from foldable materials that are similar to the foldable material 12, but the respective center portions 14 and foldable extensions $\mathbf{16}_A$, $\mathbf{16}_B$, $\mathbf{16}_D$, $\mathbf{16}_D$ are shaped differently. Similarly, the inner support members 22', 22", 22'" include an ISM center portion 30 and side securing members 32, but as shown FIGS. 3 through 5, the shape of the respective inner support members 22', 22", 22'" corresponds with the particular three-dimensional supporting frame 20',20",20'". Each of the three-dimensional supporting frame 20', 20", 20'" also includes the compressible material 41 positioned on outer walls 1' for securing a portion of the image receiving medium 44 to the three-dimensional supporting frames 20', 20", 20'".

FIG. 3 illustrates a triangular shaped art frame 10'. The three-dimensional supporting frame 20' includes a triangularly shaped space 28 defined by the three frame portions $\mathbf{24}_A$, $\mathbf{24}_B$, $\mathbf{24}_C$, which are formed from three foldable extensions $\mathbf{16}_A$, $\mathbf{16}_B$, $\mathbf{16}_C$ that have been folded in a manner similar to that described for the foldable material 12. The inner support member 22' is also triangular and is sized to fit into the space 28. The side securing members 32 may be individually attached to the respective inner walls 3' of the three-dimensional supporting frame 20'.

FIG. 4 illustrates a circular shaped art frame 10'. The three-dimensional supporting frame 20" includes a circular shaped space 28 defined by the four frame portions $\mathbf{24}_A$, $\mathbf{24}_B$, $\mathbf{24}_C$, $\mathbf{24}_D$ which are formed from four foldable extensions $\mathbf{16}_A$, $\mathbf{16}_B$, $\mathbf{16}_C$, $\mathbf{16}_D$ that have been folded in a manner similar to that described for the foldable material 12. The inner support member 22' is also circular and is sized to fit into the space 28. The side securing members 32 may be individually attached to the respective inner walls 3' of the three-dimensional supporting frame 20".

FIG. 5 illustrates a polygon (e.g., hexagon) shaped art frame 10". The three-dimensional supporting frame 20'" includes a hexagon shaped space 28 defined by the six frame portions $\mathbf{24}_A$, $\mathbf{24}_B$, $\mathbf{24}_C$, $\mathbf{24}_D$, $\mathbf{24}_E$, $\mathbf{24}_F$, which are formed from six foldable extensions $\mathbf{16}_A$, $\mathbf{16}_B$, $\mathbf{16}_C$, $\mathbf{16}_D$, $\mathbf{16}_E$, $\mathbf{16}_F$ that have been folded in a manner similar to that described for the foldable material 12. The inner support member 22'" is also hexagon shaped and is sized to fit into the space 28. The side securing members 32 may be individually attached to the respective inner walls 3' of the three-dimensional supporting frame 20'".

FIG. 5 also illustrates a release liner 42 positioned on the side securing members 32 of the inner support member 22". In this example, an adhesive may be applied to the outer walls of the side securing members 32. The release liner 42 covers the adhesive until it is desirable to secure the inner support member 22'" to the three-dimensional supporting frame 20'". The release liners 42 may be removed to expose the adhesive so that the outer walls of the side securing members 32 may be attached to the inner walls 3' of the three-dimensional supporting frame 20''' when the inner support member 22''' is inserted into the space 28. The adhesive and release liners 42 may be used in any of the examples of the inner support member 22, 22', 22'', 22''' disclosed herein. It is to be understood that the inner support member 22, 22', 22'', 22''' may also exclude adhesive and release liners 42. In such examples, the adhesive securing the member 22, 22', 22'', 22''' and frame 20, 20',20'', 20''' together may be pre-positioned on the walls 3' of the frame 20, 20',20'', 20''' (as described above, i.e., reference numeral 34'), the center portion 14 on the back surface 15, or combinations thereof. Adhesive may also be applied to the walls 3', center portion 14 on the back surface 15, or combinations thereof, as the inner support member 22, 22', 22'', 22''' is being inserted into the frame 20, 20', 20'', 20'''.

It is to be understood that the ranges provided herein include the stated range and any value or sub-range within the stated range. For example, a range from about −70° C. to about −40° C. should be interpreted to include not only the explicitly recited limits of about −70° C. to about −40° C., but also to include individual values, such as −65° C., −50° C., etc., and sub-ranges, such as from about −65° C. to about −45° C., from about −50° C. to about −43° C., etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed is:

1. An art frame, comprising:

a three-dimensional supporting frame, including:

an image receiving surface;

a back surface opposed to the image receiving surface;

a center portion defining a perimeter; and at least three foldable extensions extending from the perimeter, each of the foldable extensions including no less than four folds folded toward the back surface to form a frame portion having an outer wall that is substantially perpendicular to the back surface and an inner wall that is substantially perpendicular to the back surface and substantially parallel to the outer wall, wherein the inner walls together define a new perimeter;

an inner support member secured to the three-dimensional supporting frame, the inner support member formed of a blank including:

an inner support member center portion having a same shape as the new perimeter and having a surface that contacts the back surface; and at least three side securing members extending from the inner support member center portion, the at least three side securing members respectively adhered to the inner wall of respective frame portions; and a compressible member attached to the outer walls to adhere an image receiving medium to the three-dimensional supporting frame, the compressible member including:

a first adhesive positioned on the outer walls;

a polymer foam substrate positioned on the first adhesive, the polymer foam substrate having a compression index ranging from about 0.4 to about 0.8; and a second adhesive positioned on the polymer foam substrate, the second adhesive to secure the image receiving medium to the three-dimensional support frame.

2. The art frame as defined in claim 1 wherein a shape of the art frame is chosen from a square, a rectangle, a circle, a triangle, and a polygon with five or more sides.

3. The art frame as defined in claim 2 wherein:

when the shape is the square, the rectangle, or the circle, the three-dimensional supporting frame includes four foldable extensions and the inner support member includes four side securing members;

when the shape is the triangle, the three-dimensional supporting frame includes three foldable extensions and the inner support member includes three side securing members; or when the shape is the polygon with five or more sides, the three-dimensional supporting frame includes five or more foldable extensions and the inner support member includes five or more side securing members.

4. An art frame, comprising:

a three-dimensional supporting frame, including:

an image receiving surface;

a back surface opposed to the image receiving surface;

a center portion defining a perimeter; and at least three foldable extensions extending from the perimeter, each of the foldable extensions including no less than four folds folded toward the back surface to form a frame portion having an outer wall that is substantially perpendicular to the back surface and an inner wall that is substantially perpendicular to the back surface and substantially parallel to the outer wall; and a compressible member attached to the outer walls to adhere an image receiving medium to the three-dimensional supporting frame, the compressible member including:

a first adhesive positioned on the outer walls;

a polymer foam substrate positioned on the first adhesive, the polymer foam substrate having a compression index ranging from about 0.4 to about 0.8, wherein the polymer foam substrate is a polymer elastomer; and a second adhesive positioned on the polymer foam substrate, the second adhesive to secure the image receiving medium to the three-dimensional support frame;

wherein the first adhesive and the second adhesive are each chosen from polyvinyl ethers, silicone resins, polyacrylic resins, nitrile rubbers, butyl rubbers, ethylene-vinyl acetate copolymers, or styrene block copolymers.

5. The art frame as defined in claim 4, further comprising a tab scored in one of the folds of each of the at least three foldable extensions and secured to the back surface.

6. An art canvas, comprising:

a three-dimensional supporting frame, including:

an image receiving surface;

a back surface opposed to the image receiving surface;

a center portion defining a perimeter; and at least three foldable extensions extending from the perimeter, each of the foldable extensions including no less than four folds folded toward the back surface to form a frame portion having an outer wall that is substantially perpendicular to the back surface and an inner wall that is substantially perpendicular to the back surface and substantially parallel to the outer wall, the inner walls together defining a new perimeter;

an inner support member secured to the three-dimensional supporting frame, the inner support member, including:

an inner support member center portion having a same shape as the new perimeter and having a surface that contacts the back surface; and at least three side securing members extending from the inner support member center portion, the at least three side securing members respectively adhered to the inner walls of respective frame portions;

an image receiving medium having an image printed thereon; and a compressible member attached to the outer walls and adhering the image receiving medium to the three-dimensional supporting frame, the compressible member including:

a first adhesive positioned on the outer walls;

a polymer foam substrate positioned on the first adhesive, the polymer foam substrate having a compression index ranging from about 0.4 to about 0.8; and a second adhesive positioned on the polymer foam substrate, the second adhesive securing the image receiving medium to the three-dimensional support frame.

7. The art canvas as defined in claim 6 wherein:

the polymer foam substrate is a polymer elastomer; and the first adhesive and the second adhesive are each chosen from a polyvinyl ethers, silicone resins, polyacrylic resins, nitrile rubbers, butyl rubbers, ethylene-vinyl acetate copolymers, or styrene block copolymers.

8. The art canvas as defined in claim 6, further comprising an adhesive positioned on at least three side securing members, the adhesive securing the inner support member to the three-dimensional supporting frame.

9. The art canvas as defined in claim 6, further comprising an adhesive positioned on the inner walls, the adhesive securing the inner support member to the three-dimensional supporting frame.

10. The art canvas as defined in claim 6, further comprising a tab scored in one of the folds of each of the at least three foldable extensions and secured to the back surface, wherein the inner support member covers the tabs.

11. The art canvas as defined in claim 6 wherein a shape of each of the three-dimensional supporting frame and the inner support member is chosen from a square, a rectangle, a circle, a triangle, and a polygon with five or more sides.

12. The art canvas as defined in claim 11 wherein:

when the shape is the square, the rectangle, or the circle, the three-dimensional supporting frame includes four frame portions and the inner support member includes four side securing members; or when the shape is the triangle, the three-dimensional supporting frame includes three frame portions and the inner support member includes three side securing members; or when the shape is the polygon with five or more sides, the three-dimensional supporting frame includes five or more frame portions and the inner support member includes five or more side securing members.

* * * * *